United States Patent [19]

Cotterill

[11] Patent Number: 5,031,867

[45] Date of Patent: Jul. 16, 1991

[54] KEYBOARD SUPPORT APPARATUS

[76] Inventor: Michael J. Cotterill, 43 Rocklea Crescent, Sylvania Heights, New South Wales 2224, Australia

[21] Appl. No.: 332,455

[22] PCT Filed: Aug. 27, 1987

[86] PCT No.: PCT/AU87/00289

§ 371 Date: Mar. 1, 1989

§ 102(e) Date: Mar. 1, 1989

[87] PCT Pub. No.: WO88/01481

PCT Pub. Date: Mar. 10, 1988

[51] Int. Cl.[5] ..... F16M 13/00

[52] U.S. Cl. ..... 248/281.1; 248/284; 248/918

[58] Field of Search ..... 248/298, 918, 280.1, 248/281.1, 292.1, 920, 921, 922, 923, 285, 284

[56] References Cited

U.S. PATENT DOCUMENTS

| | | | |
|---|---|---|---|
| 3,396,931 | 8/1968 | Eckstein | 248/280.1 |
| 3,490,727 | 1/1970 | Miller | 248/281.1 |
| 3,667,714 | 6/1972 | Ziaylek | 248/280.1 X |
| 3,765,676 | 10/1973 | Bearson et al. | 248/281.1 X |
| 3,866,866 | 2/1975 | Kneile | 248/918 X |
| 4,213,591 | 7/1980 | Jaakkola | 248/281.1 |
| 4,568,052 | 2/1986 | Solomon et al., | 248/281.1 |
| 4,640,062 | 2/1987 | Rubik | 248/280.1 X |
| 4,691,888 | 9/1987 | Cotterill | 248/918 X |
| 4,706,919 | 11/1987 | Soberalski et al. | 248/918 X |
| 4,776,284 | 10/1988 | McIntosh | 248/281.1 X |

*Primary Examiner*—David M. Purol

*Attorney, Agent, or Firm*—Pearne, Gordon, McCoy & Granger

[57] ABSTRACT

A keyboard support apparatus includes a first bracket and a second bracket interconnected by first, second and third elongate members. The first and second elongate members are pivotally attached by a first pivot pin to the first bracket. The first elongate member is also pivotally attached by a second pivot pin to the second bracket. The third elongate member is pivotally attached by a third pivot pin to the first bracket, while the second and third elongate members cooperate with a further pivot pin on the second bracket to releasably engage the second and third elongate members. The first and second brackets are connected to a supporting surface and a keyboard, respectively, and the elongate members are movable in substantially the same plane when released from the second bracket.

5 Claims, 2 Drawing Sheets

KEYBOARD SUPPORT APPARATUS

TECHNICAL FIELD

This invention relates to a support apparatus suitable, but not exclusively, for supporting an electronic keyboard from a desk.

BACKGROUND ART

Electronic keyboards are commonly used on desks in offices and it is desirable to present the keyboard to the operator at a convenient position and orientation. Owing to the wide range in the requirements of keyboard operators it is known to provide versatile keyboard supports which may be adjusted to present the keyboard in a convenient position and orientation. Such keyboard supports suffer from the drawback that they are cumbersome and difficult to adjust. In particular it is a problem that after the keyboard has been moved from its working position, in order for the desk to be used for another purpose, a lengthy adjustment procedure is necessary before the keyboard can be returned to the optimum working position.

DISCLOSURE OF INVENTION

According to the invention there is provided a keyboard support apparatus comprising:

a first bracket and a second bracket interconnected by first, second and third elongate members; said first and second elongate members are pivotally attached by means of a first pivot pin to said first bracket; said first elongate member is also pivotally attached by means of a second pivot pin to said second bracket; said third elongate member is pivotally attached by means of a third pivot pin to said first bracket; said second and third elongate members are adapted to co-operate with a fourth pivot pin associated with said second bracket, and said fourth pivot pin is adapted to releasably engage said second and third elongate members; the arrangement being such that, in use, one of the first and second brackets is connected to a supporting surface and the other to a keyboard and the elongate members, when released from engagement with the second bracket, are moveable substantially in the same plane.

BRIEF DESCRIPTION OF DRAWINGS

A preferred embodiment will now be described by way of example only with reference to the accompanying drawings in which.

BEST MODE FOR CARRYING OUT INVENTION

Figure 1:
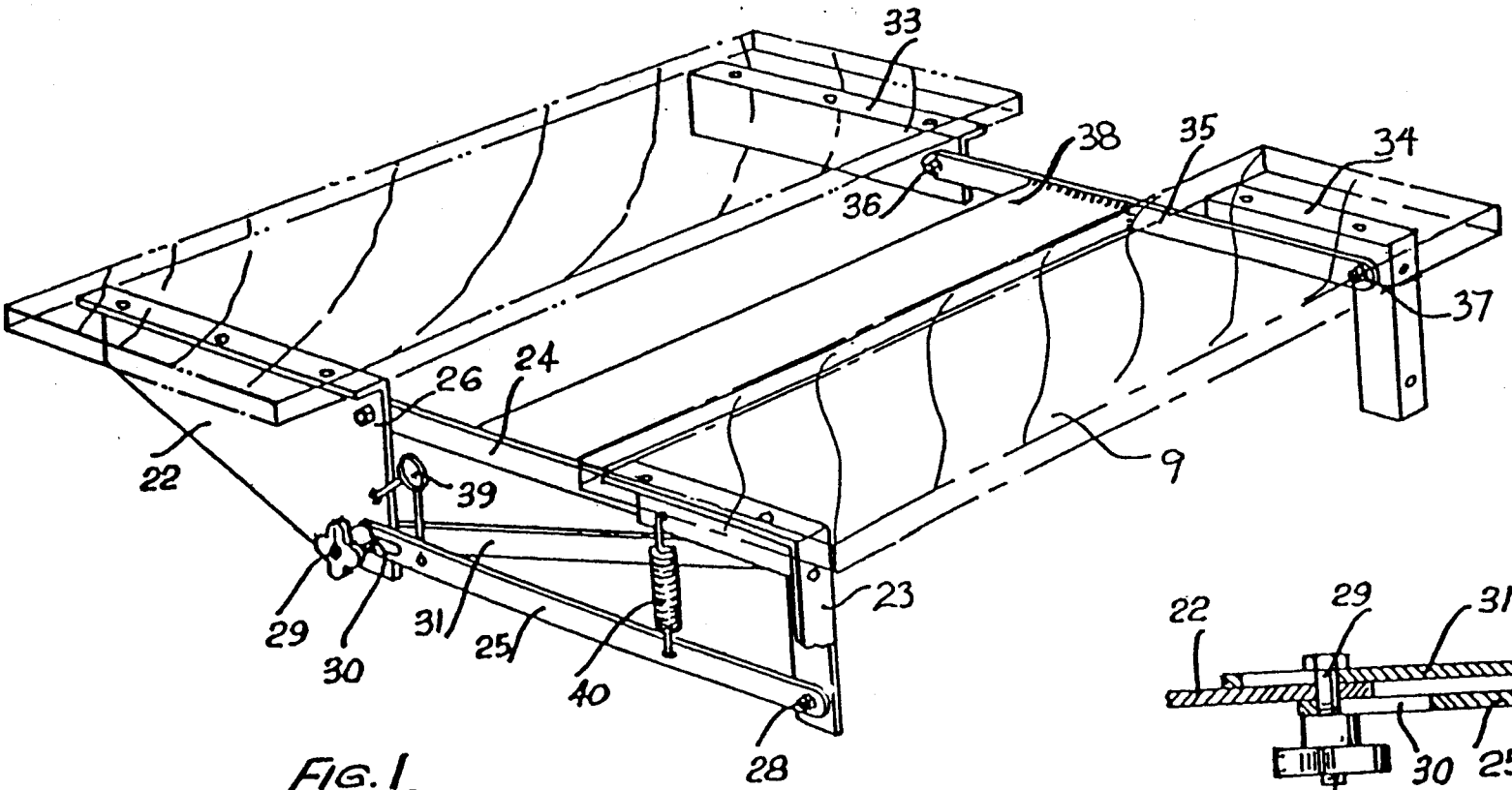
FIG. 1 shows a perspective view of keyboard support apparatus embodying the invention.
Figure 2:
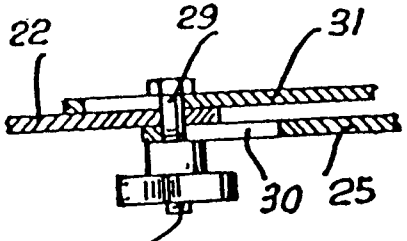
FIG. 2 shows a detail of part of the keyboard support apparatus shown in FIG. 1.

Referring now to FIGS. 1–4, keyboard attaching bracket 22 to which a keyboard or shelf may be bolted is connected to keyboard mounting block attaching bracket 23 by means of two parallel elongate members 24 and 25. Elongate member 24 is attached to bracket 23 by means of pivot pin 27, and attached to bracket 22 by means of pivot pin 26. Elongate member 25 is attached to bracket 23 by means of pivot Pin 28, and is attached to bracket 22 by means of pivot pin 29 which resides in longitudinal slot 30 of elongate member 25.

A third elongate member 31 interconnects brackets 22 and 23. Elongate member 31 is attached to bracket 23 by means of pivot pin 27 and is attached to bracket 22 by means of pivot pin 29 which engages in longitudinal slot 32 of member 31.

Bracket 22 is connected at one side of the underside of a keyboard, and bracket 23 is connected at one side of the underside of a keyboard mounting body, such as a desk (not shown) This connection may be made, for instance, by bolts which pass through holes in the overhang 35 of bracket 25 and through holes or slots (not shown) of the mounting body). Further brackets 33 and 34 are connected to the other sides of the keyboard and mounting body in order to prevent rotation of the keyboard with respect to the mounting body. Brackets 33 and 34 are interconnected by a further elongate member 35 which is pivotally attached at either end by means of pivot pins 36 and 37 respectively. An alternative arrangement would be to connect brackets 22 and 23 at the centres of the keyboard and keyboard mounting body, in which case brackets 33 and 34 could be dispensed with.

A cross member 38 provides the final degree of stability to the structure.

Figure 3:
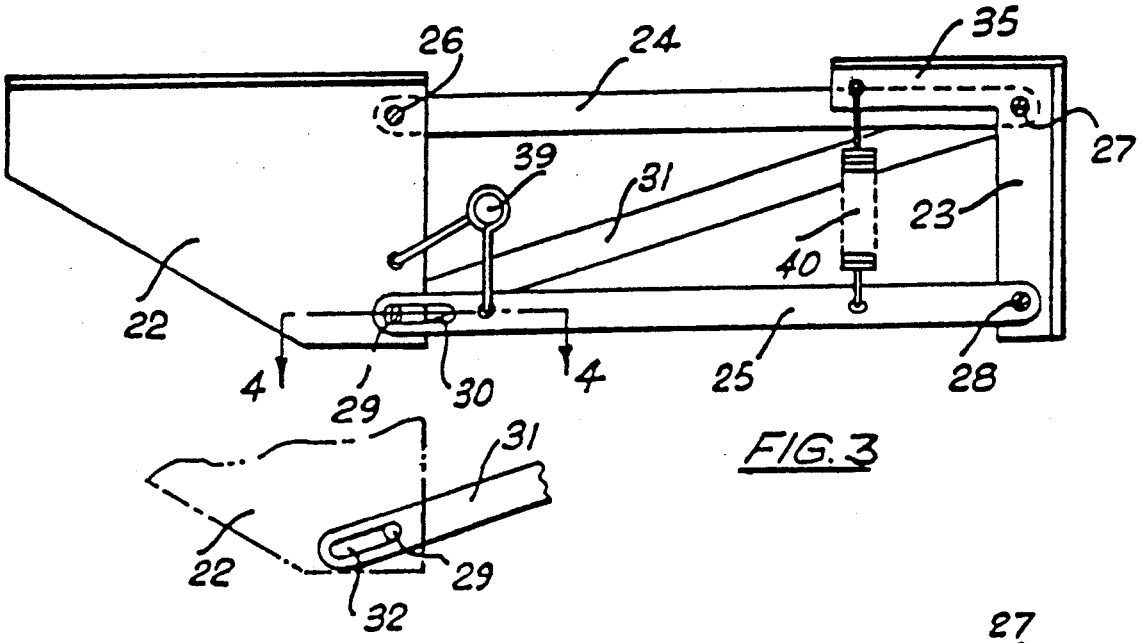
FIG. 3 shows a side view of the keyboard support apparatus shown in FIG. 1 at one extreme of its travel.
Figure 4:
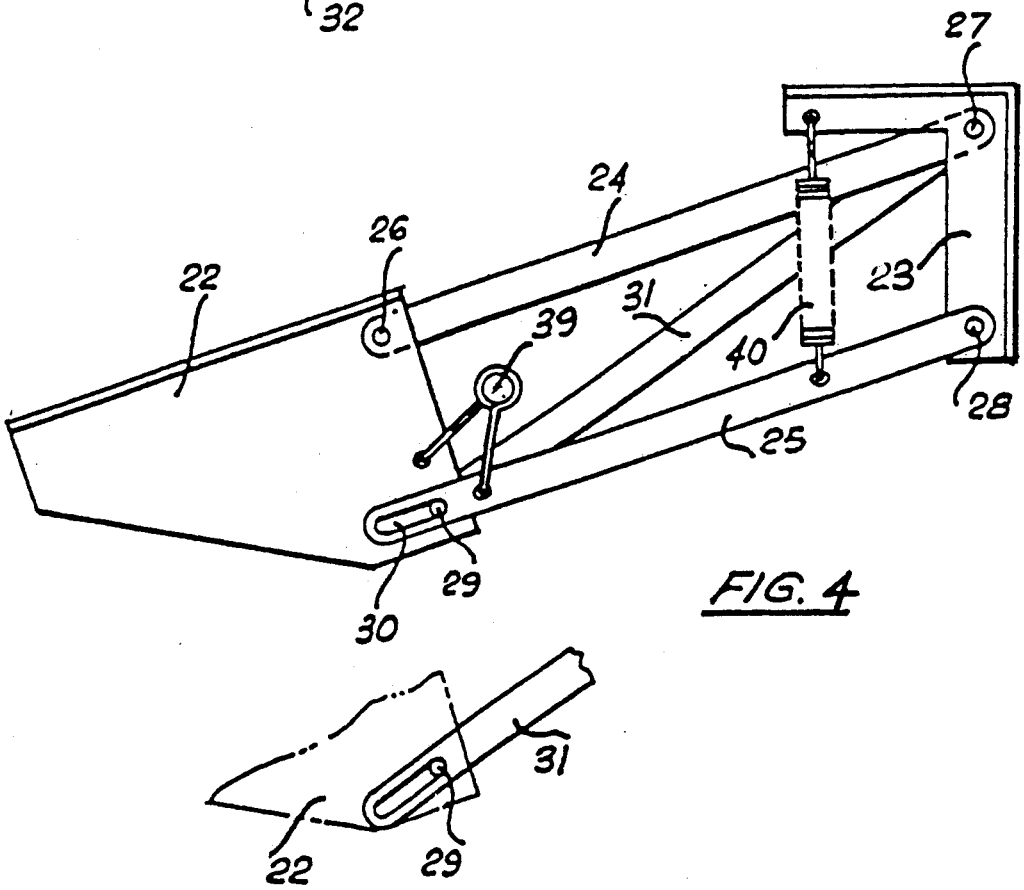
FIG. 4 shows a side view of the keyboard support apparatus shown in FIG. 1 at the other extreme of its travel.

A comparison of FIGS. 3 and 4 will indicate that only a limited amount of pivotal movement is possible by elongate members 24 and 25 around pivot pins 27 and 28. The precise amount of movement permitted is determined by the length of the slot 30. In FIG. 4 it can be seen that bracket 22 may be tilted in a clockwise direction about pivot 26 ar amount determined by the length of either slot 30 or slot 32.

It should be appreciated that rotation is possible by any desired amount between the two extreme positions shown in FIGS. 3 and 4 respectively. Also, at any intermediate position between the two extremes shown some degree of tilt is possible.

Pivot pin 29 is essentially a threaded bolt, that is at least some part of the pin which extends beyond the surface of elongate member 25 is threaded. A nut, preferably turnable by hand, may be tightened or loosened on the threaded portion of pivot pin 29 in order to clamp or release elongate members 25 and 31, and bracket 22. This is illustrated in greater detail in FIG. 2. It is an advantage of this arrangement that the structure may be adjusted to desired angle and tilt with one hand.

To facilitate operation and to counteract the weight of the keyboard a spring 39 may be provided connecting the elongate member 25 and bracket 22. Spring 39 comes under greater tension when bracket 22 is moved downwards with respect to bracket 23, i.e., when the arms of the spring are compressed together. This has the effect of returning the desktop to the horizontal.

A further spring 40, for instance a coil spring, may connect an overhang 35 of bracket 23 to elongate member 25. This spring also comes under greater tension when bracket 22 is moved downwards with respect to bracket 23. The action of the spring therefore serves to return bracket 22 and therefore the keyboard, to its highest position.

Although the invention has been described with reference to a specific example, it will be appreciated by those skilled in the art that the invention may be embodied in many other forms. For instance, the invention has been described with reference to structures suitable for right-hand operation when mounted under the operator's desk, but it should be clear that left-handed operation is equally possible and may be facilited by mirror image construction. It is also feasilbe that dual-controls may be provided on either side of the structure, both or either of which may be used to control the movements. It should also be appreciated that the shapes of all the brackets and bodies need not be limited to those shown. Also the elongate members and rods need not have the cross section shown.

I claim:

1. A keyboard support apparatus comprising:

a first bracket and a second bracket interconnected by first, second and third elongate members; said first and second elongate members being pivotally attached by means of a first pivot pin to said first bracket; said first elongate member being also pivotally attached by means of a second pivot pin to said second bracket; said third elongate member being pivotally attached by means of a third pivot pin to said first bracket; said second and third elongate members being pivotally attached with a fourth pivot pin disposed on said second bracket, and said fourth pivot pin being arranged so as move relative to at least one of said second and third elongate members along an axially directed rectilinear path defined by said at least one of said members and to releasably clamp said second and third elongate members in a preselected position; the arrangement being such that, in use, one of the first and second brackets is connected to a supporting surface and the other to a keyboard, and the elongate members, when released from engagement with the second bracket, are movable substantially in the same plane.

2. A keyboard support apparatus as claimed in claim 1 wherein:

3. A keyboard support apparatus as claimed in claim 1 in which a first spring interconnects said third elongate member and said second bracket such that the first spring comes under greater tension when the second bracket is moved downwards with respect to the first bracket.

4. A keyboard support apparatus as claimed in claim 3 in which a second spring interconnects an overhang of the first bracket and the third elongate member such that the second spring comes under greater tension when the second bracket is moved downward with respect to the first bracket.

5. A keyboard support apparatus as claimed in claim 2, wherein the fourth pivot pin is threaded to adjustably cooperate with a manually operable nut to releasably clamp the second and third elongate members.

* * * * *

UNITED STATES PATENT AND TRADEMARK OFFICE

CERTIFICATE OF CORRECTION

PATENT NO. : 5,031,867

DATED : July 16, 1991

INVENTOR(S) : Michael J. Cotterill

It is certified that error appears in the above-identified patent and that said Letters Patent is hereby corrected as shown below:

Column 3, line 25, "so as move" should read --so as to move--.

Column 4, line 10, after "wherein" the following text should be inserted:

--the second and third elongate members each have a slot in which the fourth pin resides.--

Signed and Sealed this

Twenty-second Day of December, 1992

*Attest:*

DOUGLAS B. COMER

*Attesting Officer*

*Acting Commissioner of Patents and Trademarks*